US011242704B2

(12) United States Patent
Girotto et al.

(10) Patent No.: US 11,242,704 B2
(45) Date of Patent: Feb. 8, 2022

(54) ANTI-DERAILMENT DEVICE FOR SLIDING LEAVES OF FURNITURE ITEMS

(71) Applicant: BORTOLUZZI SISTEMI S.P.A., Belluno (IT)

(72) Inventors: Adriano Girotto, Belluno (IT); Rodolfo Dal Castel, Belluno (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 114 days.

(21) Appl. No.: 16/633,236

(22) PCT Filed: Jul. 13, 2018

(86) PCT No.: PCT/IB2018/055178
§ 371 (c)(1),
(2) Date: Jan. 23, 2020

(87) PCT Pub. No.: WO2019/021100
PCT Pub. Date: Jan. 31, 2019

(65) Prior Publication Data

US 2020/0157864 A1 May 21, 2020

(30) Foreign Application Priority Data

Jul. 24, 2017 (IT) ..... 102017000084318

(51) Int. Cl.
*E05D 13/00* (2006.01)
*E05D 15/06* (2006.01)
*E05D 15/08* (2006.01)

(52) U.S. Cl.
CPC ..... *E05D 15/0634* (2013.01); *E05D 15/08* (2013.01); *E05Y 2201/614* (2013.01); *E05Y 2900/20* (2013.01)

(58) Field of Classification Search
CPC ... E05D 15/0634; E05D 15/08; E05D 15/063; E05Y 2201/614; E05Y 2900/20; E05F 5/003
USPC ..... 49/425, 409, 410, 411, 412
See application file for complete search history.

(56) References Cited

U.S. PATENT DOCUMENTS 2,664,598 A * 1/1954 Greig ..... E06B 3/4636 49/420
9,032,588 B2 * 5/2015 Chen ..... E06B 7/28 16/87.6 R
9,101,239 B2 * 8/2015 Cavarec ..... A47H 5/0325
9,879,460 B2 * 1/2018 Nilsson ..... E05F 5/003
(Continued)

FOREIGN PATENT DOCUMENTS

CA 960915 A1 1/1975
DE 3209768 A1 * 9/1983 ..... A47K 3/34
(Continued)

*Primary Examiner* — Jerry E Redman
(74) *Attorney, Agent, or Firm* — Mark M. Friedman

(57) ABSTRACT

An anti-derailment system is described for a wheel which can roll on a track and is pivoted on a carriage which translatably supports a leaf of a piece of furniture. The system has a slider which is inseparably mountable or mounted on the track and is able to translate on the track independently of the carriage, and a constraint element for constraining the slider and at least one of the wheel, the carriage or the leaf to each other, so as to keep the wheel in condition of rolling on the track without derailing.

8 Claims, 2 Drawing Sheets

(56) References Cited

U.S. PATENT DOCUMENTS

| | | | | |
|---|---|---|---|---|
| 2002/0170141 | A1* | 11/2002 | Cherukuri | B60B 33/063 16/91 |
| 2007/0017065 | A1* | 1/2007 | Hutnik | E05D 15/0669 16/91 |
| 2012/0186046 | A1* | 7/2012 | Pelekanos | E05D 15/26 16/87 R |
| 2013/0042534 | A1* | 2/2013 | Polus | E05D 15/0686 49/425 |
| 2013/0205542 | A1* | 8/2013 | Backman | E05D 15/0634 16/102 |
| 2014/0115968 | A1* | 5/2014 | Wei | E05F 11/54 49/352 |
| 2014/0115969 | A1* | 5/2014 | Wei | E05D 13/00 49/352 |
| 2014/0143980 | A1* | 5/2014 | Chang | E05D 15/0639 16/91 |
| 2014/0250629 | A1* | 9/2014 | Chen | E05D 15/0621 16/102 |
| 2015/0337582 | A1* | 11/2015 | Halfon | F03D 9/16 16/97 |
| 2017/0114582 | A1* | 4/2017 | Ishikawa | E05F 5/003 |
| 2017/0275936 | A1* | 9/2017 | Wolfe | E05D 15/0686 |
| 2018/0230728 | A1* | 8/2018 | Downey | E05F 5/003 |
| 2018/0283070 | A1* | 10/2018 | Hamilton | E05D 15/0669 |

FOREIGN PATENT DOCUMENTS

| | | | |
|---|---|---|---|
| DE | 202009010218 | U1 | 1/2010 |
| EP | 2330262 | A2 | 6/2011 |
| FR | 2601405 | A1 | 1/1988 |
| JP | 03047387 | A * | 2/1991 |

* cited by examiner

ANTI-DERAILMENT DEVICE FOR SLIDING LEAVES OF FURNITURE ITEMS

FIELD AND BACKGROUND OF THE INVENTION

The invention refers to an anti-derailing method and device for sliding furniture leafs.

Furniture sliding leafs in general are supported by carriages having wheels rolling over linear tracks, to make the leaves movable with little friction. A common problem is how to avoid the derailment of the wheels from the tracks, because an accidental bump on the leaf or its arrival at the limit position with too much speed is sometimes sufficient to disengage a wheel from the track below, requiring then maintenance with several inconveniences.

In WO2012156338 a carriage of the above-mentioned type is described comprising a manually operated clamp. Through a lever it is possible to move the clamp to slidably engage the track and avoid detachment of the wheel. The main flaws of this solution are complexity and cost of the clamp, the inconvenience during its activation, and the constraint of having to make the carriage adapting it to the clamp, thereby forcedly sacrificing degrees of design freedom.

SUMMMARY OF THE INVENTION

Improving this state of the art is the main object of the invention, which is defined in the attached claims, in which the dependent ones define advantageous variants.

Another object is to propose an anti-derailment method and device that is more simple to use and less expensive, and/or applicable to existing carriages.

A first aspect of the invention is a method for preventing the derailment of a wheel which can roll on a track and is pivoted on a carriage which supports translatably a leaf of a piece of furniture, comprising the steps of (i) inseparably mounting on the track a slider able to translate on the track independently of the carriage, and (ii) constraining the slider to at least one of the wheel, the carriage or the leaf to keep the wheel in condition of rolling on the track without derailing.

Thus a simple and effective way is obtained to anchor the wheel to the track.

Step (ii) can occur in many ways, e.g. through a rigid link or a cord or a chain.

Preferably step (ii) is carried out in such a way as to allow a relative displacement vertically between the slider and said at least one of the wheel, the carriage or leaf. This allows to finely adjust the position of the leaf after the mounting is completed even after the wheel has been mounted on the track.

Preferably in step (ii) the slider is constrained to the carriage, and even more preferably the constraint is obtained by means of reciprocal snap-coupling portions, and/or by means of reciprocal coupling portions having mechanical play, such as to permit said relative displacement in vertical direction.

Preferably, step (i) takes place through a shape-coupling between a portion of the slider and the cross-section of the track. Said portion of the slider and the cross-section of the track form e.g. a prismatic pair or a shape-fitted pair.

Preferably, step (i) takes place before step (ii), i.e.

first, a slider is mounted on the track capable of translating on the track both without detaching from the track and independently from the carriage, and then the slider is constrained, that is to say it is connected or attached, to at least one of the wheel, carriage or leaf to keep the wheel in a position to roll on track without derailing.

The order of step (i) with respect to step (ii) can also be reversed, remaining in any case the fact that the slider and the at least one of the wheel, the carriage or the leaf are initially detached, and e.g. also mounted separately on the furniture item, and then bound to each other to keep the wheel in a position to roll on the track without derailing.

A second aspect of the invention is an anti-derailment system for a wheel which can roll on a track and is pivoted on a carriage which translatably supports a leaf of a piece of furniture), characterized by a slider which is inseparably mountable (or mounted) on the track and is able to translate on the track independently of the carriage, and a constraint element for constraining the slider and at least one of the wheel, the carriage or the leaf to each other, so as to keep the wheel in condition of rolling on the track without derailing.

As can be seen, with respect to WO2012156338 the system and the method provide more degrees of freedom in choosing how to connect the slider to the components that translate the leaf on the track.

Another advantage is the possibility of providing any leaf of the aforementioned type with an anti-derailment system, regardless of the structure of the carriage used.

As mentioned, the slider is structured so as to translate on the track regardless of the carriage, the wheel or the leaf. That is, the carriage or the wheel are configured so as to be able to translate on the track independently of the slider. That is to say that the slider, the carriage and the wheel are constructed as distinct parts, i.e. detached or detachable pieces, but which are then constrained to be integral by said constraining phase (ii) and/or the constraint element.

Preferably, the carriage and/or the wheel and/or the leaf are held integral with the slider only through said constraining phase (ii) and/or the constraint element.

Preferably the constraint element or the connection or constraint between the slider and said at least one of the wheel, the carriage or the leaf comprises a mechanical play so as to allow a relative displacement vertically between the slider and said at least one of the wheel, the carriage or the leaf. The effect is to allow finely adjusting the position of the leaf after finishing the assembly, even after the wheel has been mounted on the track.

The constraint element may have many embodiments, e.g. as a rigid connection element, or a flexible element such as a cord or chain.

The system may comprise an elastic element mounted to exert a return force between the slider and said at least one of the wheel, the carriage or the leaf. The effect is to bring the wheel back to the position in which it engages the track and cancel or minimize instant detachments between the two.

In particular, the slider is constrained to the carriage. In this variant, the slider and the carriage preferably comprise snap-fittingly mutually-fixable portions. In particular, the fixable portions comprise flexible fins, comprised in the slider, which are snap-fittingly engageable in a slot of the carriage. Preferably, the slot has larger dimensions than the fins' (e.g. an oval with vertical major axis), for determining said mechanical play. The position of the fins and the slot can also be exchanged.

Preferably, the slider is coupled to the track by a coupling portion that with the cross-section of the track constitutes a shape-fitting closing pair or a prismatic pair. In particular, the coupling portion comprises two separated wings configured to embrace in a complementary manner the sides of the track.

BRIEF DESCRIPTION OF THE DRAWINGS

The advantages of the invention will be even clearer from the following description of a favorite example of an anti-derailment system, referring to the attached drawing in which.

DETAILED DESCRIPTION OF THE INVENTION

Figure 1:
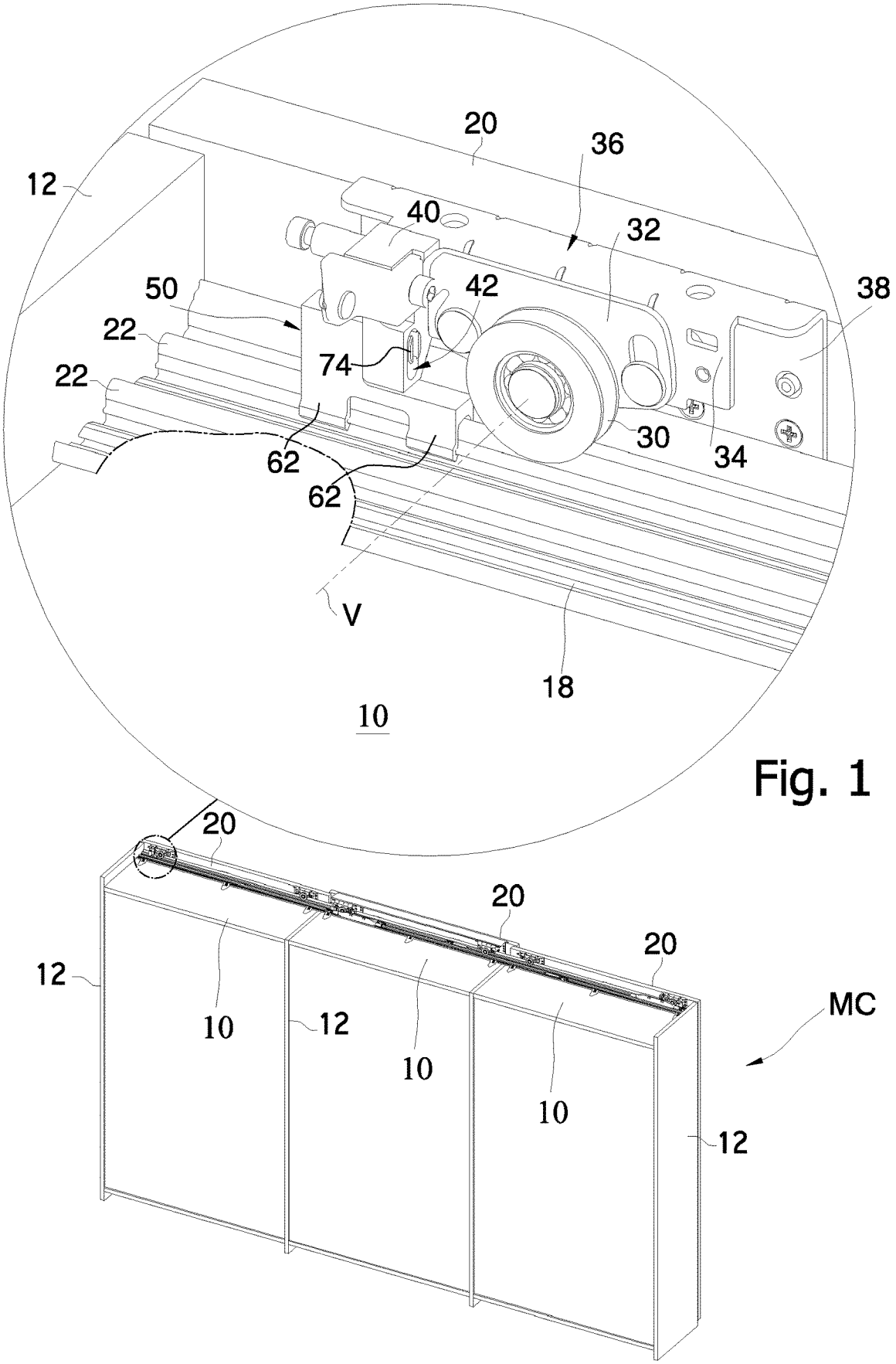
FIG. 1 shows a three-dimensional view of the system.
Figure 2:
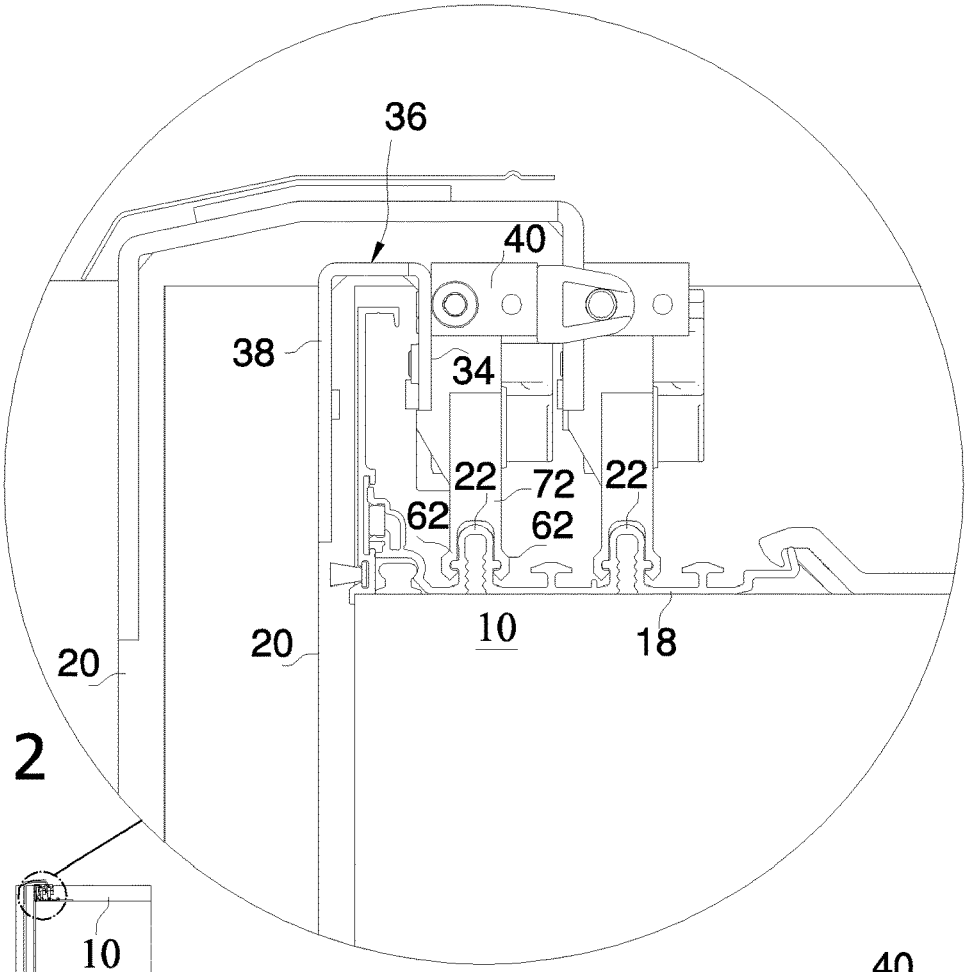
FIG. 2 shows a side view of the system.

In the figures, equal numbers indicate equal or conceptually similar parts, and the elements are described as in use.

A furniture item MC comprises a ceiling 10 and dividing sidewalls 12, in front of which leafs are mounted sliding one on the other to close a relative compartment. The example shows three leafs, but we will refer only to one for the sake of simplicity, since all are equipped with the same device.

A metal section bar 18 having corrugations 22 exploited as a linear track is fixed on the ceiling 10. A leaf has two wheels 30, aligned and separated along the section bar 18, which are slidable on the section bar 18.

Each wheel 30 is rotatable about a horizontal axis V, and is pivoted on a plate 32 adjustable on a vertical plate 34 of a U-shaped bracket 36, which comprises a second vertical plate 38 screwed to the leaf 20.

Figure 3:
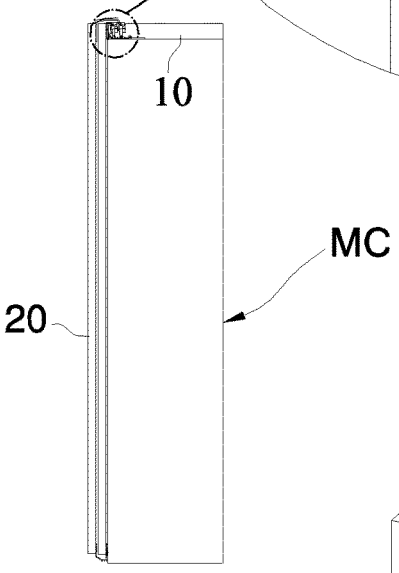
FIG. 3 shows a three-dimensional view of a component of a carriage.
Figure 3:
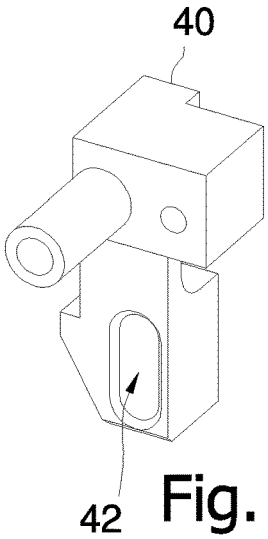

An end-position block 40 is screwed to the plate 34, next to the plate 32, (see also FIG. 3) and is equipped with a vertical pass-through slot 42. In the example, the slot 42 is of oval or elliptical cross-section, where the major axis of the oval or ellipse is vertical, and the slot's axis (the depth) is parallel to the longitudinal direction of the corrugations 22.

Figure 4:
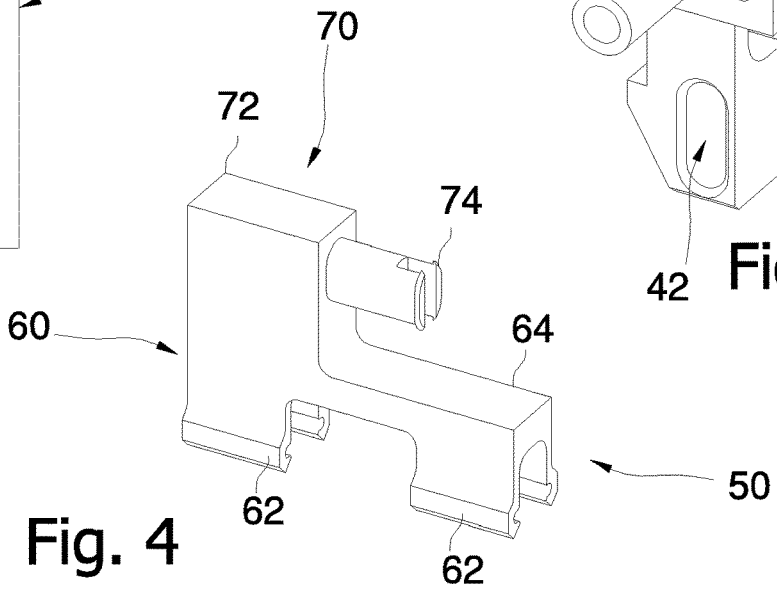
FIG. 4 shows a three-dimensional view of a slider.

On the corrugation 22 occupied by a wheel 30, a slider 50 is mounted (see also FIG. 4), which comprises a base 60 and a head 70.

The base 60 comprises a horizontal segment 64 from whose ends there extend two vertical forks 62 spaced apart. The forks 62 are snugly placed in a straddling fashion on the corrugation 22 and delimit therebetween a cavity of shape complementary to the cross-section of the corrugation 22. In this way the slider 50 can slide along and on the corrugation 22 without detaching from it.

The head 70 comprises a vertical neck 72 from which two horizontal flexible fins 74 extend, which are insertable into the slot 42.

During assembly of the leaf 20, by inserting the fins into the slot 42 the block 40 is connected to the slider 50, so that they can slide together on the section bar 18.

As a result, to the slider 50 there is also constrained the leaf 20, which is anchored slidingly to the section bar 18 by means of the wheel 30. The wheel 30 is now constrained with respect to the corrugation 22 below and does not derail, because the slider 50 prevents it from getting too far from the section bar 18.

To allow a fine adjustment of the leaf 20 when mounted, it is preferable that the dimensions of the slot 42 allow the fins 74 to slide therein with a small vertical play, to facilitate adjustment of the plate 32 on the bracket 36. E.g. the slot 42 may form a short vertical guide in which the fins 74 can translate for a short distance.

The play is useful for regulating small tolerances of a leaf 20 and assembly tolerances between adjacent leafs.

The invention claimed is:

1. Anti-derailment system for a wheel which can roll on a track and is pivoted on a carriage which translatably supports a leaf of a piece of furniture, characterized by a slider which is inseparably mountable on the track and is able to translate on the track independently of the carriage, and a constraint element for constraining to each other the slider and at least one of the wheel, the carriage or the leaf, so as to keep the wheel in condition of rolling on the track without derailing, wherein the slider is constrained to the carriage, and the slider and the carriage comprise snap-fit portions fastenable to each other, wherein the fastenable portions comprise flexible fins snap-fittingly engageable in a slot, the slot being larger than the fins to determine a mechanical play.

2. System according to claim 1, wherein said mechanical play determined by the constraint between the slider and said at least one of the wheel, the carriage or the leaf is configured to allow a relative displacement vertically between the slider and said at least one of the wheel, the carriage or the leaf.

3. System according to claim 2, wherein the slider is coupled to the track by means of a coupling portion which with a cross-section of the track constitutes a prismatic or shape-fitting pair.

4. System according to claim 1, wherein the slider is coupled to the track by means of a coupling portion which with a cross-section of the track constitutes a prismatic or shape-fitting pair.

5. System according to claim 4, wherein the coupling portion comprises two divaricated fins which are configured to straddle the sides of the track in a complementary way.

6. System according to claim 1, wherein at least two of (i) the wheel, (ii) the carriage, or (iii) the leaf are held integral with the slider only through said constraint element.

7. System according to claim 1, wherein the constraint element is a rigid connection element.

8. System according to claim 1, comprising an elastic element mounted to exert a return force between the slider and said at least one of the wheel, the carriage or the leaf.

* * * * *